US011352859B2

(12) United States Patent
Nguyen et al.

(10) Patent No.: US 11,352,859 B2
(45) Date of Patent: Jun. 7, 2022

(54) WELL PRODUCTION ENHANCEMENT SYSTEMS AND METHODS TO ENHANCE WELL PRODUCTION

(71) Applicant: Halliburton Energy Services, Inc., Houston, TX (US)

(72) Inventors: Philip D. Nguyen, Houston, TX (US); Michael W. Sanders, Houston, TX (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/572,096

(22) Filed: Sep. 16, 2019

(65) Prior Publication Data

US 2021/0079766 A1 Mar. 18, 2021

(51) Int. Cl.
*E21B 43/263* (2006.01)
*E21B 43/116* (2006.01)
*E21B 43/114* (2006.01)

(52) U.S. Cl.
CPC ..... *E21B 43/116* (2013.01); *E21B 43/114* (2013.01); *E21B 43/263* (2013.01)

(58) Field of Classification Search
CPC ..... E21B 43/263; E21B 43/26; E21B 43/261; E21B 43/267; E21B 43/248
See application file for complete search history.

(56) References Cited

U.S. PATENT DOCUMENTS 5,355,802 A 10/1994 Petitjean
7,228,906 B2 6/2007 Snider et al.
7,353,866 B2 4/2008 Snider et al.
7,431,075 B2 10/2008 Brooks et al.
7,565,930 B2 7/2009 Seekford
7,571,768 B2 8/2009 Cuthill
(Continued)

FOREIGN PATENT DOCUMENTS

WO 2015159304 A2 10/2015
WO 2017075139 A1 5/2017
WO 2017143181 A1 8/2017

OTHER PUBLICATIONS

International Search Report & Written Opinion in PCT/US2020/040953, dated Oct. 30, 2020.

*Primary Examiner* — Kipp C Wallace
(74) *Attorney, Agent, or Firm* — McGuireWoods LLP

(57) ABSTRACT

Well production enhancement systems and methods to enhance well production are disclosed. The method includes deploying an outer conveyance into a wellbore, where a plurality of propellants are deployed along a section of the outer conveyance. The method also includes deploying one or more isolation devices to form one or more isolation zones along the outer conveyance. The method further includes deploying an inner conveyance within the outer conveyance, where the inner conveyance is initially deployed along the section of the outer conveyance. The method further includes detonating the plurality of propellants to generate one or more fractures in a formation proximate to the section of the outer conveyance. The method further includes injecting fracture enhancement fluids into the one or more fractures to enhance well production through the one or more fractures.

19 Claims, 9 Drawing Sheets

(56) References Cited

U.S. PATENT DOCUMENTS 7,810,569 B2 * 10/2010 Hill ..... E21B 23/065 166/299
7,950,457 B2 5/2011 Seekford
8,469,110 B2 6/2013 Sanders et al.
8,522,863 B2 9/2013 Tiernan
8,607,704 B2 12/2013 Stark et al.
8,689,876 B2 4/2014 Loree et al.
9,027,641 B2 5/2015 Alekseenko et al.
9,062,545 B2 6/2015 Roberts et al.
9,182,207 B2 11/2015 McPherson et al.
9,447,672 B2 9/2016 Arrell, Jr. et al.
9,453,402 B1 9/2016 Barton et al.
9,470,079 B1 10/2016 Schmidt et al.
9,611,718 B1 * 4/2017 Bond ..... E21B 34/00
9,689,247 B2 6/2017 Holder et al.
9,896,920 B2 2/2018 Holder
9,950,124 B2 4/2018 Imai et al.
10,087,734 B2 10/2018 Fehr et al.
10,113,388 B2 10/2018 Stewart et al.
10,138,720 B2 * 11/2018 Kemick ..... E21B 43/248
2003/0037692 A1 2/2003 Liu
2003/0230406 A1 * 12/2003 Lund ..... E21B 43/116 166/278
2007/0163775 A1 7/2007 Walton et al.
2007/0251690 A1 * 11/2007 Whitsitt ..... E21B 43/117 166/278
2008/0053658 A1 * 3/2008 Wesson ..... E21B 43/114 166/297
2009/0071651 A1 * 3/2009 Patel ..... E21B 43/10 166/297
2009/0266549 A1 * 10/2009 Braithwaite ..... E21B 33/124 166/313
2010/0044047 A1 2/2010 Kabishcher et al.
2015/0007994 A1 * 1/2015 Lancaster ..... E21B 43/1185 166/297
2015/0083440 A1 * 3/2015 Andersen ..... E21B 34/14 166/387
2015/0240613 A1 8/2015 Alekseenko et al.
2016/0084059 A1 3/2016 Moore et al.
2016/0298438 A1 * 10/2016 Livescu ..... E21B 43/119
2017/0009563 A1 1/2017 Holder
2017/0204713 A1 7/2017 Bell et al.
2017/0234116 A1 * 8/2017 Gilliat ..... E21B 43/117 166/297
2018/0202277 A1 7/2018 Sawka et al.

* cited by examiner

WELL PRODUCTION ENHANCEMENT SYSTEMS AND METHODS TO ENHANCE WELL PRODUCTION

BACKGROUND

The present disclosure relates generally to methods and systems for well production enhancement.

Hydraulic fracturing is a technique often used to access resource deposits such as hydrocarbon deposits and other types of resources trapped in a rock formation, such as a shale formation. Hydraulic fracturing is often combined with horizontal drilling to reduce the surface disturbance of the drilling operation, and also to reach multiple hydrocarbon deposits spread across vast areas.

Hydraulic fracturing operations often utilize massive volumes of water and proppants that are not only financially costly to produce, transport, and pump downhole, but also take up enormous footprints at well sites. Further, the significant volumes of water and proppants pumped downhole also proportionally increase pump time thereby delaying completion and eventual hydrocarbon production operations. Further, the use of massive volumes of water may be more difficult at well sites situated in areas with little water resources or situated far from areas with sufficient water resources to support hydraulic fracturing operations. In addition, the fluids used for fracturing operations ideally need to be removed from the formation to optimize production. In that regard, the fluid removal process to remove such fluids increases proportionally to the amount of fluids pumped downhole.

BRIEF DESCRIPTION OF THE DRAWINGS

Illustrative embodiments of the present disclosure are described in detail below with reference to the attached drawing figures, which are incorporated by reference herein, and wherein.

Figure 1:
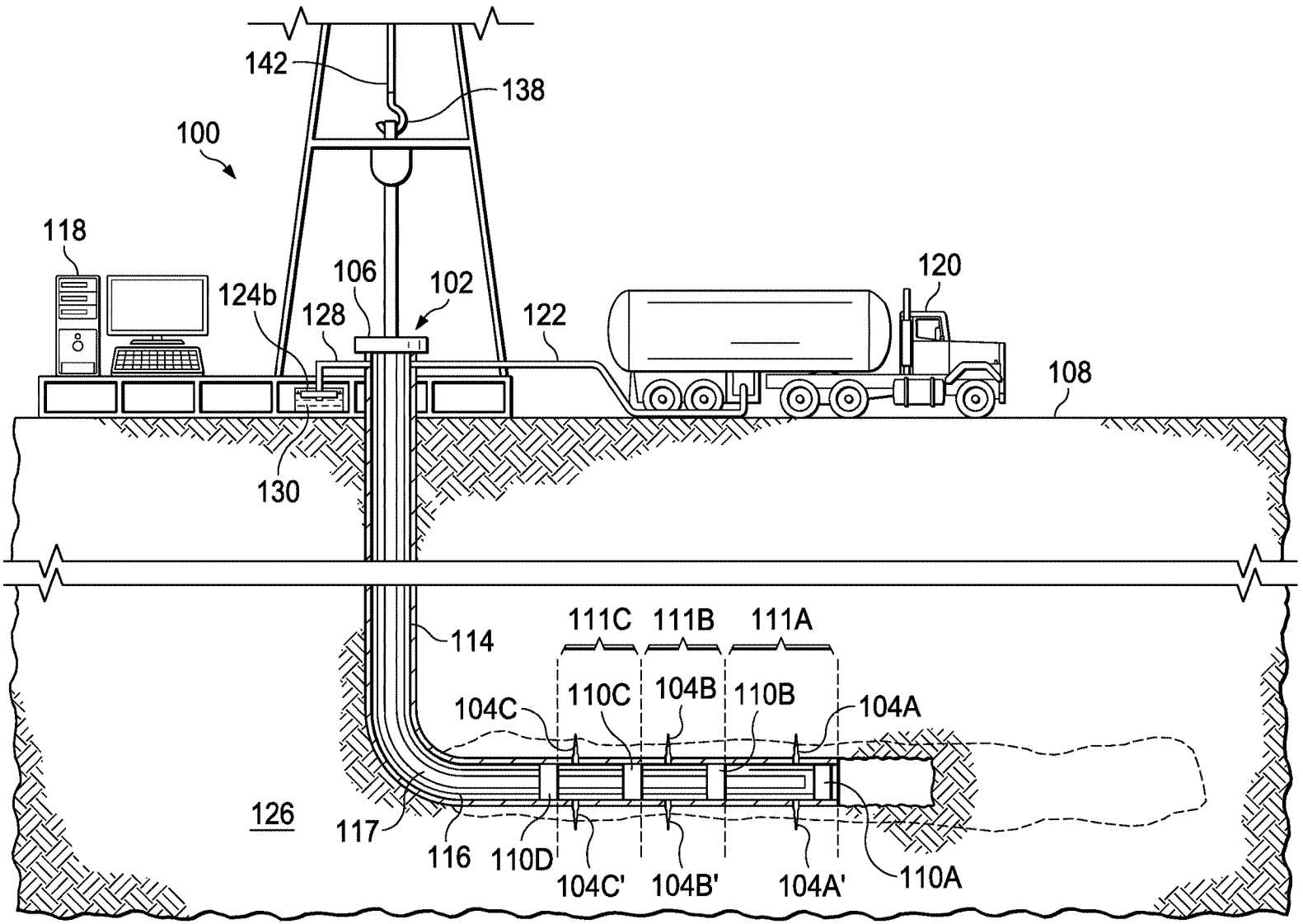
FIG. 1 is a schematic, side view of a hydraulic fracking environment that includes a wellbore having a well production enhancement system deployed in the wellbore to enhance well production.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to methods and systems for well production enhancement. Well production enhancement systems described herein are deployable in open-hole and cased-hole wellbores. A well production enhancement system deployed in an open-hole wellbore includes an outer conveyance that is deployable in the wellbore and an inner conveyance that is deployable inside of the outer conveyance (i.e., forming an annulus between the inner conveyance and the outer conveyance). As referred to herein, a conveyance may be a work string, drill string, drill pipe, wireline, slickline, coiled tubing, production tubing, downhole tractor or another type of conveyance operable to be deployed in a wellbore. In some embodiments, the outer conveyance is a work string and the inner conveyance is a coiled tubing that is deployed within the working string. The well production enhancement system includes isolation devices that form isolation zones along the outer conveyance. As referred to herein, an isolation device includes any device operable to isolate a section of a conveyance or surrounding wellbore from other sections of the conveyance or surrounding wellbore. Further, as referred to herein, an isolation zone is an area along the conveyance or the wellbore that is isolated (e.g., fluidly isolated) from other areas along the conveyance or the wellbore. Examples of isolation devices include, but are not limited to, packers, frac plugs, frac balls, sealing balls, sliding sleeves, bridge plugs, cement sleeves, wipers, pipe plugs, as well as other types of devices operable to isolate a section of the conveyance or the wellbore. In some embodiments, the isolation devices are also used to anchor one or more sections of the outer conveyance to the wellbore. In some embodiments, the isolation devices are deployed before the inner conveyance is deployed in the outer conveyance. In some embodiments, isolation devices along different sections of the wellbore are deployed at different times.

The well production enhancement system also includes propellants deployed along each section of the wellbore. As referred to herein, a propellant includes any chemical material operable to produce energy, pressurized gas, or in some cases release heat, that generates fractures along the formation. The propellants are detonated to generate fractures along the formation at an isolation zone. In some embodiments, some propellants are detonated before other propellants to create a pulsing effect which enhances fractures generated along the formation. In some embodiments, a detonation cord coupled to the propellants is ignited or actuated to detonate the propellants. Fracture enhancement fluids are then pumped through the conveyance and into the fractures to enhance the fractures. As referred to herein, fracture enhancement fluids are any fluids having properties that extend the fracture length, the fracture complexity, or enhance the well production through the fractures. Examples of fracture enhancement fluids include, but are not limited to, different types of fracture fluids and treatment fluids. In some embodiments, fracture enhancement fluids are pumped into the wellbore and the fractures while the propellants are being detonated. For example, the fracture enhancement fluids are pumped into the wellbore after one fourth (or a different amount) of propellants deployed along an isolation zone have been detonated. In one or more of such embodiments, the remaining propellants are detonated in a timed sequence (e.g., in a pulsed frequency) while the fracture enhancement fluids are pumped into the wellbore and fractures. In one or more of such embodiment, all of the propellants deployed in the isolation section are detonated while fracture enhancement fluids are pumped into the wellbore and fractures. In one or more of such embodiments, operations to pump fracture enhancement fluids into the isolation zone complete before all of the propellants are detonated. In some embodiments, the well production enhancement system includes multiple sliding sleeves or other components deployed along the outer conveyance that are actuated to allow fluids to flow through the outer conveyance and into the wellbore and fractures. In one or more of such embodiments, after propellants deployed along the isolation zone are detonated to form fractures, the inner conveyance actuates a sliding sleeve deployed along the isolation zone to allow fracture enhancement fluids to flow through the opening of the sliding sleeve and into the fractures. In some embodiments, the fracture enhancement fluids are pressurized (either at the surface or downhole) before the fluids are injected into the fractures to further enhance the fractures. In some embodiments, the fracture enhancement fluids are pressurized by continuing injection through the conveyance and maintaining injection pressure. In some embodiments, the fracture enhancement fluids (pressurized or unpressurized) are pumped into the formation immediately or within a threshold period of time after the detonation of the propellants. In one or more embodiments, the fractures are first filled with a clean frac fluid (i.e., a frac fluid with little to no solids) followed with a sand-laden fluid. Additional descriptions of a wellbore production enhancement system deployed in an open-hole wellbore are provided in the paragraphs below and are illustrated in at least FIGS. 2A-2C.

In some embodiments, a well production enhancement system similar to the previously described well production enhancement system is deployed in cased wellbores. In such embodiments, the well production enhancement system also includes an outer conveyance, an inner conveyance deployed inside the outer conveyance, isolation devices deployable to form isolation zones, and propellants. The well production enhancement system also includes a perforation tool that is deployable along different zones of interest along the outer conveyance and operable to perforate the respective zones of interest. As referred to herein, a perforation tool is any tool or component operable to perforate a conveyance or formation. Examples of perforation tools include, but are not limited to, hydrojet/hydrajet tools, perforation guns, as well as other tools operable to perforate a conveyance or formation. Further, and as referred to herein, a zone of interest is an area along a section of the outer conveyance that is a designated zone for perforation operations. In one or more embodiments, the zone of interest is an area along a section of the outer conveyance that does not contain any propellants, or where perforation within the area would not detonate any propellant deployed nearby. In some embodiments, the perforation tool is attached to the inner conveyance, is towed by the inner conveyance to a zone of interest, and is actuated to perforate the zone of interest. After perforation of the zone of interest, the propellants are detonated to form fractures along the isolation zone, and fracture enhancement fluids are pumped through the inner conveyance, through the perforations in the zone of interest, and into the fractures to enhance the fractures. Further, after injecting the fracture enhancement fluids, an isolation material is injected into the perforated zone of interest to isolate the perforated zone of interest. As referred to herein, an isolation material includes any fluid or solid-based material operable to isolate (e.g., fluidly isolate) the perforated zone of interest from other zones or sections. Additional descriptions of a wellbore production enhancement system deployed in a cased wellbore are provided in the paragraphs below and are illustrated in at least FIGS. 3A-3F.

In some embodiments, a well production enhancement system deployed in cased wellbores first operates a perforation tool to perforate each zone (or multiple zones) of interest along a cased wellbore. Conveyance joints of the well production enhancement system are deployed into the wellbore after the foregoing perforation operation. The well production enhancement system includes sliding sleeves and propellants that are deployable along each conveyance joint. In some embodiments, propellants are placed on sleeves (propellant sleeves). In some embodiments, propellant sleeves and inflatable packers are connected to a conveyance (e.g., the inner conveyance, the outer conveyance, or another conveyance deployable downhole) or a conveyance joint, and are deployed downhole together with the conveyance or the conveyance joint. In one or more of such embodiments, sliding sleeves are placed above each propellant sleeve. In one or more of such embodiments, sliding sleeves are placed between two or more propellant sleeves. In one or more of such embodiments, a propellant sleeve is a sleeve or a cylinder of propellant. In such embodiments, the propellant sleeve slides over a conveyance and is attached in place on the conveyance. In one or more of such embodiments, the propellant sleeve slides over the inner conveyance and welded on both ends to the inner conveyance. In one or more of such embodiments, the propellant sleeve is screwed on to an inner surface of the outer conveyance. The well production enhancement system also includes isolation devices deployable along the conveyance joints to isolate each conveyance joint from adjacent conveyance joints, and to form an isolation zone along each respective conveyance joint. The conveyance joints are connected to form an outer conveyance, and an inner conveyance is deployed inside of the connected outer conveyance (i.e., forming an annulus between the inner conveyance and the outer conveyance). After the conveyance joints are connected to form the outer conveyance, propellants along a conveyance joint are detonated to form fractures in the formation proximate to the conveyance joint. Further, a sliding sleeve along the conveyance joint is actuated to provide a fluid flow path allowing the pressurized fracture enhancement fluids to flow out from the outer conveyance, through the opened sliding sleeve, and into the formed fractures. Fracture enhancement fluids are then pumped through the outer conveyance, through the opened sliding sleeve, and into the fractures to enhance the fractures. The sliding sleeve is then closed, the inner conveyance is re-deployed to another conveyance joint, and operations to detonate propellants deployed along the other conveyance joint, open a sliding sleeve, pump fracture enhancement fluids into the fractures, and close the sliding sleeve are repeated. In some embodiments, the well production enhancement system also includes electronic devices (controllers) operable to monitor operations performed during well production enhancement operations. Additional descriptions of well production enhancement systems and method to enhance well production are provided in the paragraphs below and are illustrated in FIGS. 1-6.

Turning now to the figures, FIG. 1 is a schematic, side view of a hydraulic fracking environment 100 that includes a wellbore 114 having a well production enhancement system deployed in the wellbore 114 to enhance well production. As shown in FIG. 1, wellbore 114 extends from surface 108 of well 102 to or through formation 126. A hook 138, a cable 142, traveling block (not shown), and hoist (not shown) are provided to lower conveyances 116 and 117 of the well production enhancement system down wellbore 114 of well 102 or to lift conveyance 117 up from wellhead 106 of well 102. The well production enhancement system includes isolation devices 110A-110D that are positioned along different sections of conveyance 116 and are deployable to form isolation zones 111A-111C, respectively. In the embodiment of FIG. 1, isolation devices 110A-110D are deployed to form isolation zone 111A, isolation zone 111B, and isolation zone 111C. In some embodiments, the well production enhancement system includes additional isolation devices that are deployable to form additional isolation zones. In the embodiment of FIG. 1, conveyance 116 is a work string and conveyance 117 is a coiled tubing that is deployed inside conveyance 116. Further, propellants (not shown) which, when detonated, form fractures similar to fractures 104A, 104A', 104B, 104B', 104C, 104C' 104D, and 104D' are deployed along conveyance 116.

At wellhead 106, an inlet conduit 122 is coupled to a fluid source 120 to provide fluids and materials, such as fracture enhancement fluids and isolation materials into well 102 and formation 126. For example, fracture enhancement fluids are pumped through inlet conduit 122, through conveyance 117, down wellbore 114, and into fractures 104A, 104A', 104B, 104B', 104C, 104C' 104D, and 104D', to enhance the respective fractures. In some embodiments, a perforation tool (not shown) is actuated to perforate conveyance 116 and formation 126 at a zone of interest. In some embodiments, propellants in the first isolation zone are detonated to form fractures 104A and 104A' and fracture enhancement fluids are pumped through conveyance 117, through conveyance 116, and eventually into fractures 104A and 104A'. In some embodiments, where conveyance 116 includes a sliding sleeve (not shown), the sliding sleeve is actuated to facilitate fluid flow through the sliding sleeve and into fractures 104A and 104A'. After fractures 104A and 104A' are enhanced through the foregoing process, conveyance 117 is re-deployed to isolation zone 111B, and the process is then repeated to enhance fractures in isolation zone 111B. The foregoing process is repeated until fractures in each isolation zone are enhanced.

In the embodiment of FIG. 1, fluids are circulated into the well through conveyance 116 and back toward surface 108. To that end, a diverter or an outlet conduit 128 may be connected to a container 130 at the wellhead 106 to provide a fluid return flow path from wellbore 114. In some embodiments, isolation devices 110A-110C are configured to dissolve upon prolonged exposure to wellbore fluids, including upon exposure to certain solvents that may be included in the wellbore fluid. In such embodiments, the components of isolation devices 110A-110C are water-soluble, oil-soluble, or soluble in the presence of other solvent fluids, such as, but not limited to, alcohol-based fluids, acetone-based fluids, and propanediol-based fluids. In the embodiment of FIG. 1, operations described herein are monitored by controllers 118 at surface 108. Although FIG. 1 illustrates controllers 118 as surface-based devices, in some embodiments, one or more components of controllers are located downhole. Further, in some embodiments, controllers are located at a remote location. Further, in some embodiments, controllers 118 are components of the well production enhancement system. In some embodiments, controllers 118 provide status of one or more operations performed during well production enhancement operations for display. In one or more of such embodiments, an operator having access to controllers 118 operates controllers 118 to analyze well production enhancement operations, and in some cases, to make adjustments to well production enhancement operations including, but not limited to, detonating propellants, re-deploying conveyance 117, actuating a perforation tool (not shown), as well as other operations described herein. In some embodiments, controllers 118 dynamically monitor, analyze, and adjust one or more well production enhancement operations.

Although FIG. 1 illustrates a cased wellbore, the well production enhancement system illustrated in FIG. 1, as well as other well production enhancement systems described herein, are deployable in open-hole wellbores, and cased wellbores and open-hole wellbores of offshore wells. Further, although FIG. 1 illustrates a well production enhancement system having four isolation devices that form three isolation zones, the well production enhancement system may include a different number of isolation devices that form a different number of isolation zones. Additional descriptions and illustrations of well production enhancement systems are provided in the paragraphs below and are illustrated in at least FIGS. 2A-2C, 3A-3E, and 4. Further, additional descriptions and illustrations of methods to enhance well production are provided in the paragraphs below and are illustrated in at least FIGS. 5 and 6.

Figure 2A:
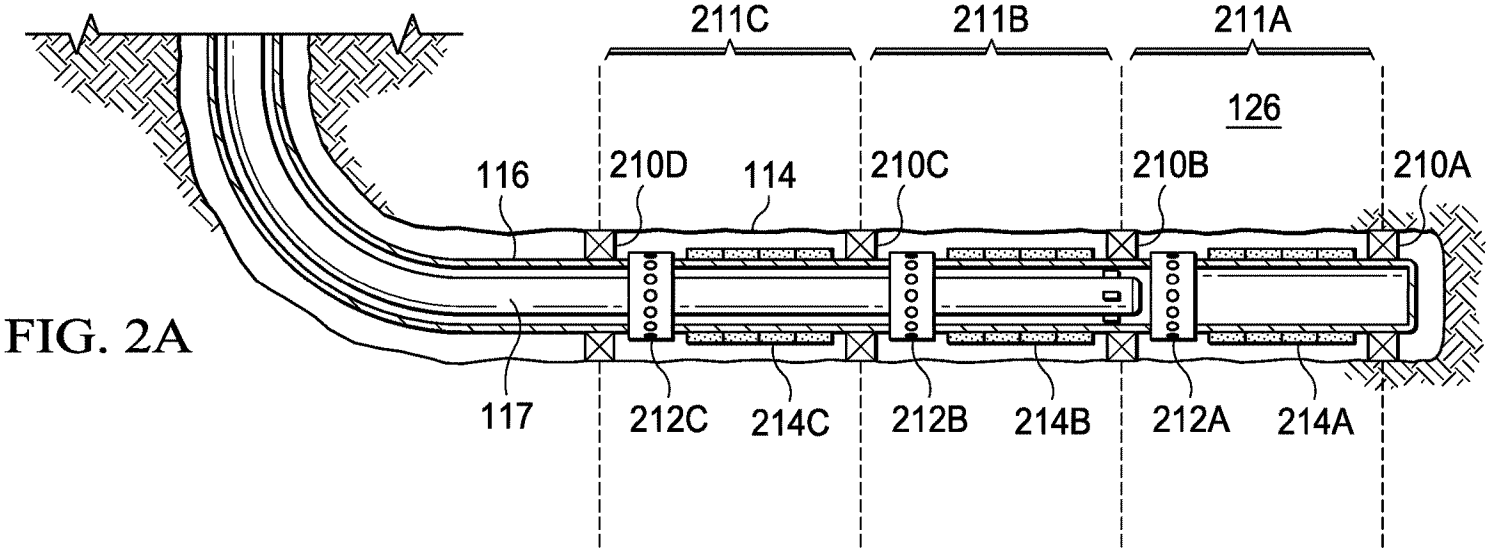
FIG. 2A is a cross-sectional view of a well production enhancement system similar to the well production enhancement system of FIG. 1 and deployed in an open-hole wellbore.
Figure 2B:
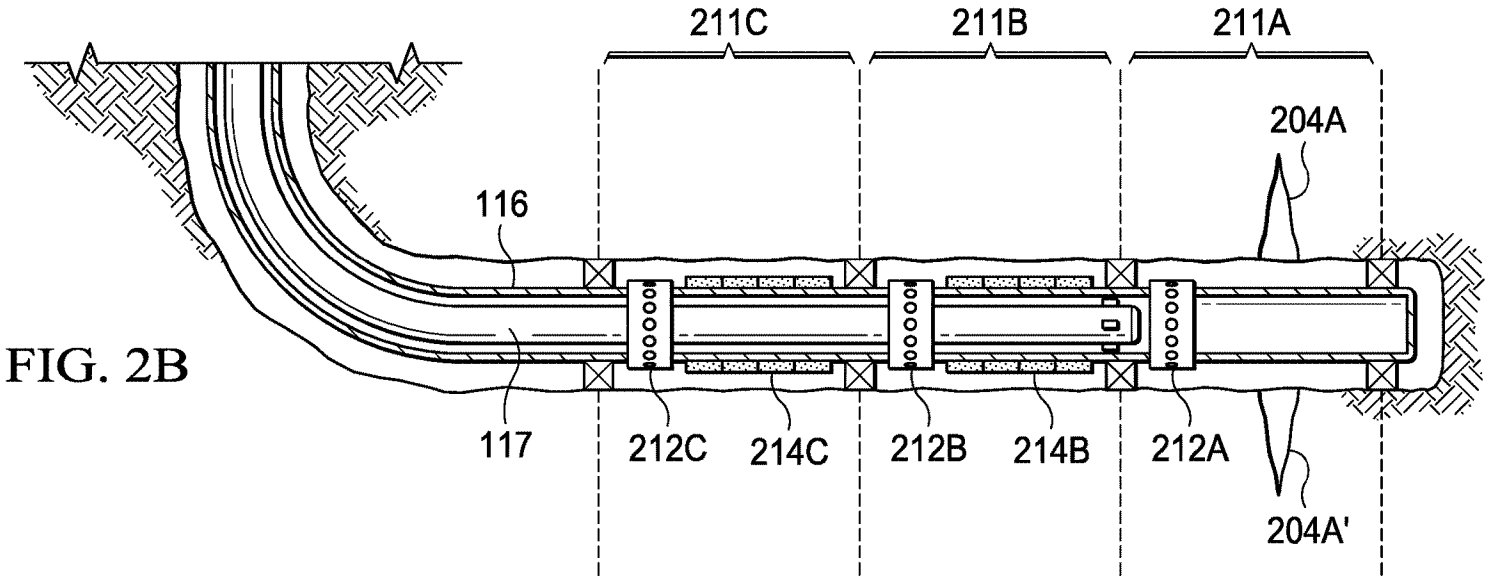
FIG. 2B is a cross-sectional view of the well production enhancement system of FIG. 2A after propellants deployed in an isolation zone are detonated to form fractures along the isolation zone.
Figure 2C:
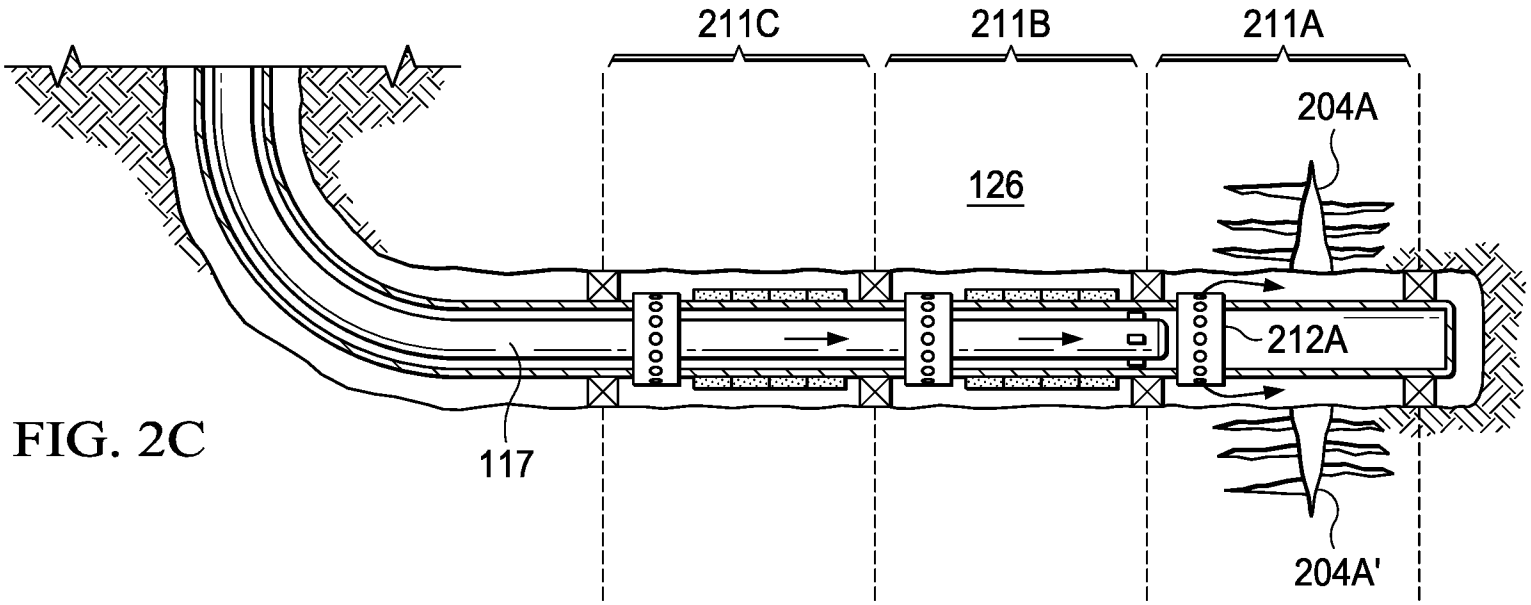
FIG. 2C is a cross-sectional view of the well production enhancement system of FIG. 2B after fracture enhancement fluids are pumped through an inner conveyance into the formation to enhance fractures along the isolation zone.

FIG. 2A is a cross-sectional view of a well production enhancement system similar to the well production enhancement system of FIG. 1 and deployed in an open-hole wellbore. In the embodiment of FIG. 2A, the well production enhancement system includes conveyance 116 and conveyance 117, which is deployed inside conveyance 116. The well production enhancement system also includes isolation devices 210A-210D that are deployed along different sections of conveyance 116. In the embodiment of FIG. 2A, isolation devices 210A-210D are deployed to form isolation zones 211A, 211B, and 211C, and to anchor conveyance 116 to wellbore 114. In that regard, dashed lines in FIGS. 2A-2C illustrate boundaries of isolation zones that extend from conveyance 116 through formation 126. In some embodiments, isolation devices 210A-210D are deployed one zone at a time to isolate the zone. Further, the well production enhancement system also includes propellants 214A-214C, which are deployed in isolation zones 211A-211C. Further, the well production enhancement system also includes sliding sleeves 212A-212C, each deployed along a section of conveyance 116. In the illustrated embodiment of FIG. 2A, each sliding sleeve 212A, 212B, or 212C is operable to open to allow fluids such as fracture enhancement fluids to flow through conveyance 116, and into fractures of formation 126 to enhance the fractures.

FIG. 2B is a cross-sectional view of the well production enhancement system of FIG. 2A after propellants deployed in isolation zone 211A are detonated to form fractures 204A and 204A' along isolation zone 211A. In some embodiments, some of propellants 214A of FIG. 2A are detonated before other propellants 214A to create a pulsing effect, which enhances fractures generated along isolation zone 211A. In the embodiment of FIG. 2B, propellants 214B and 214C are not detonated, and sliding sleeves 212B and 212C, which are deployed in isolation zones 211B and 211C, respectively, are not actuated until well production enhancement operations are performed in isolation zone 211A and 211B, respectively. After detonating propellants 214A of FIG. 2A to form fractures 204A and 204A', conveyance 117 actuates sliding sleeve 212A to allow fluids flowing through conveyance 116 to also flow through conveyance 116 via sliding sleeve 212A, and eventually into fractures 204A and 204A'. For example, fracture enhancement fluids are pumped through conveyance 116, out of sliding sleeve 212A of conveyance 116, and into fractures 204A and 204A'. In that regard, FIG. 2C is a cross-sectional view of the well production enhancement system of FIG. 2B after fracture enhancement fluids are pumped through conveyance 116 and into formation 126 to enhance fractures 204A and 204A' along isolation zone 211A. In some embodiments, the fracture enhancement fluids are fracture fluids. In some embodiments, the fracture enhancement fluids are stimulation treatment fluids, or other types of fluids that extend the length, extend the complexity, or enhance other properties of fractures 204A and 204A'. Upon completion of well production enhancement operations described and illustrated in FIGS. 2A-2C, conveyance 117 is re-deployed from isolation zone 211A to isolation zone 211B, and the processes described and illustrated in FIGS. 2A-2C are performed again to form fractures in isolation zone 211B and 211C, and to enhance fractures formed in the respective isolation zones.

Figure 3A:
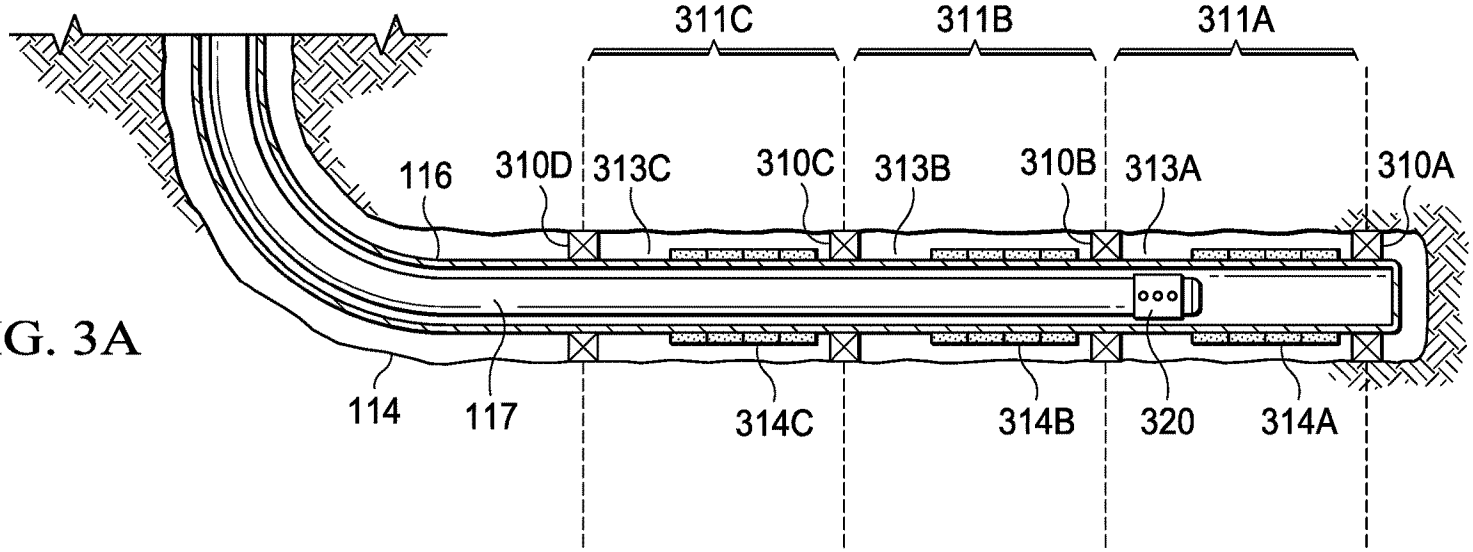
FIG. 3A is a cross-sectional view of the well production enhancement system similar to the well production enhancement system of FIG. 1 and deployed in a cased wellbore.

FIG. 3A is a cross-sectional view of the well production enhancement system similar to the well production enhancement system of FIG. 1 and deployed in a cased wellbore. In the embodiment of FIG. 3A, the well production enhancement system includes conveyance 116 and conveyance 117, which is deployed inside conveyance 116. The well production enhancement system also includes isolation devices 310A-310D that are deployed along different sections of conveyance 116. In the embodiment of FIG. 3A, isolation devices 310A-310D are deployed to form isolation zones 311A-311C, and to anchor conveyance 116 to wellbore 114. In that regard, dashed lines in FIGS. 3A-3E illustrate boundaries of isolation zones that extend from conveyance 116 through formation 126. In some embodiments, isolation devices 310A-310D are deployed one zone at a time to isolate the zone that will be fractured. Further, the well production enhancement system also includes propellants 314A-314C, which are deployed in isolation zones 311A-311C. Further, the well production enhancement system also includes a perforation tool 320. In some embodiments, the perforation tool 320 is a hydrojet/hydrajet tool. In some embodiments, the perforation tool is a perforation gun, or another tool operable to perforate conveyance 116 and the surrounding formation. In the embodiment of FIG. 3A, perforation tool 320 is initially deployed in a zone of interest 313A of isolation zone 311A. In the illustrated embodiment, zones of interest 313A-313C are areas along conveyance 116 where propellants 314A-314C are not deployed at and where performing perforation operations within the respective zone of interest would not detonate any propellants 314A-314C.

Figure 3B:
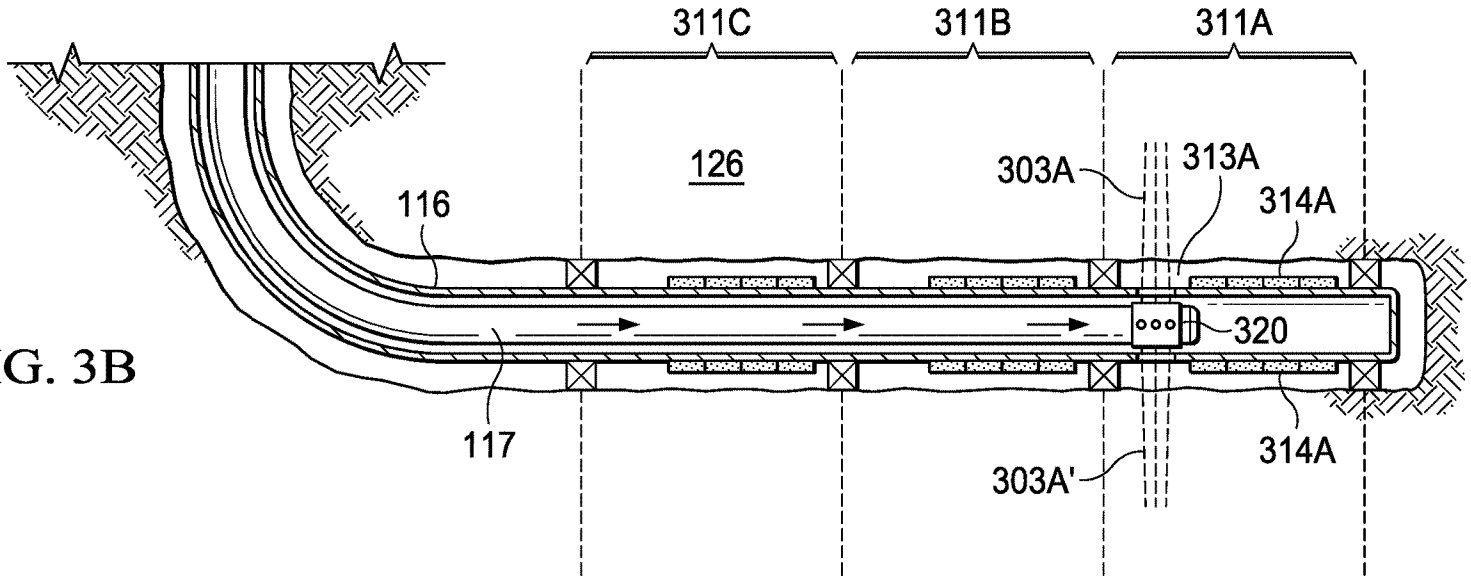
FIG. 3B is a cross-sectional view of the well production enhancement system of FIG. 3A after a perforation tool is actuated to perforate a zone of interest along the isolation zone.

FIG. 3B is a cross-sectional view of the well production enhancement system of FIG. 3A after perforation tool 320 is actuated to perforate zone of interest 313A in isolation zone 311A. In the embodiment of FIG. 3B, conveyance 117 actuates perforation tool 320 to generate perforations 303A and 303A' through conveyance 116 and into formation 126. Further, the perforation operation does not disturb propellants 314A, which are deployed outside of zone of interest 313A. In the embodiment of FIG. 3B, perforation tool 320 is a hydrojet/hydrajet operable to inject pressurized fluids through conveyance 116 and into formation 126 to form perforations 303A and 303A'. In some embodiments, perforation tool 320 is a perforation gun or other devices operable to generate perforations 303A and 303A'.

Figure 3C:
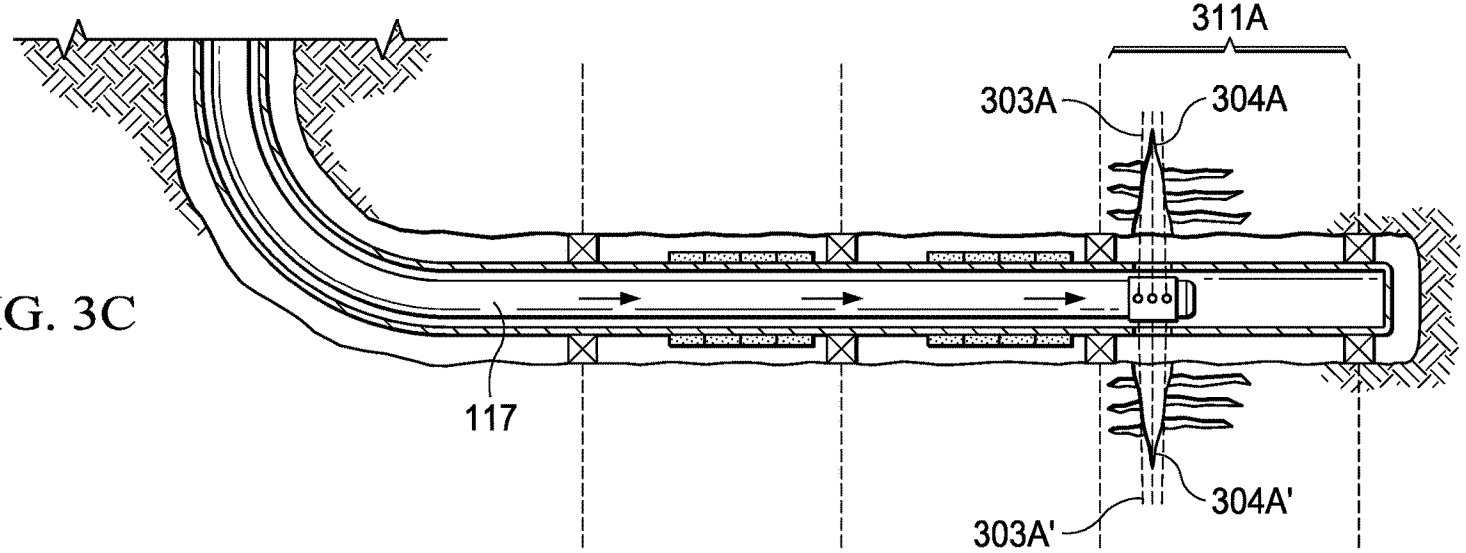
FIG. 3C is a cross-sectional view of the well production enhancement system of FIG. 3B after propellants deployed in the isolation zone are detonated to form fractures along the isolation zone.
Figure 3D:
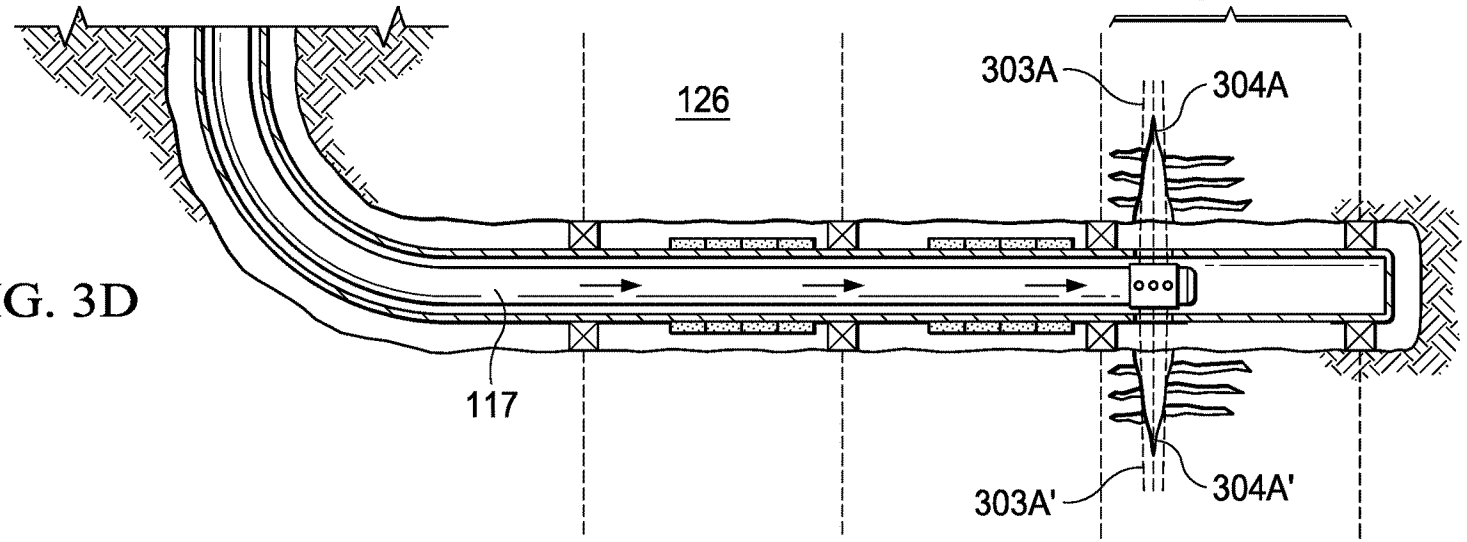
FIG. 3D is a cross-sectional view of the well production enhancement system of FIG. 3C after fracture enhancement fluids are pumped through the inner conveyance into the formation to enhance fractures along the isolation zone.

FIG. 3C is a cross-sectional view of the well production enhancement system of FIG. 3B after propellants deployed in isolation zone 311A are detonated to form fractures 304A and 304A' along isolation zone 311A. In some embodiments, some propellants deployed in isolation zone 311A are detonated before other propellants deployed in isolation zone 311A to create a pulsing effect, which enhances fractures generated along isolation zone 311A. Fracture enhancement fluids are pumped downhole through conveyance 117. FIG. 3D is a cross-sectional view of the well production enhancement system of FIG. 3C after fracture enhancement fluids are pumped through conveyance 117 and into formation 126 to enhance fractures 304A and 304A' along isolation zone 311A. As shown in FIGS. 3C and 3D, flowing fluids into fractures 304A and 304A' increased the length and complexity of fractures 304A and 304A'. In some embodiments, fracture enhancement fluids are pressurized before being injected into formation 126 to further enhance fractures 304A and 304A'.

Figure 3E:
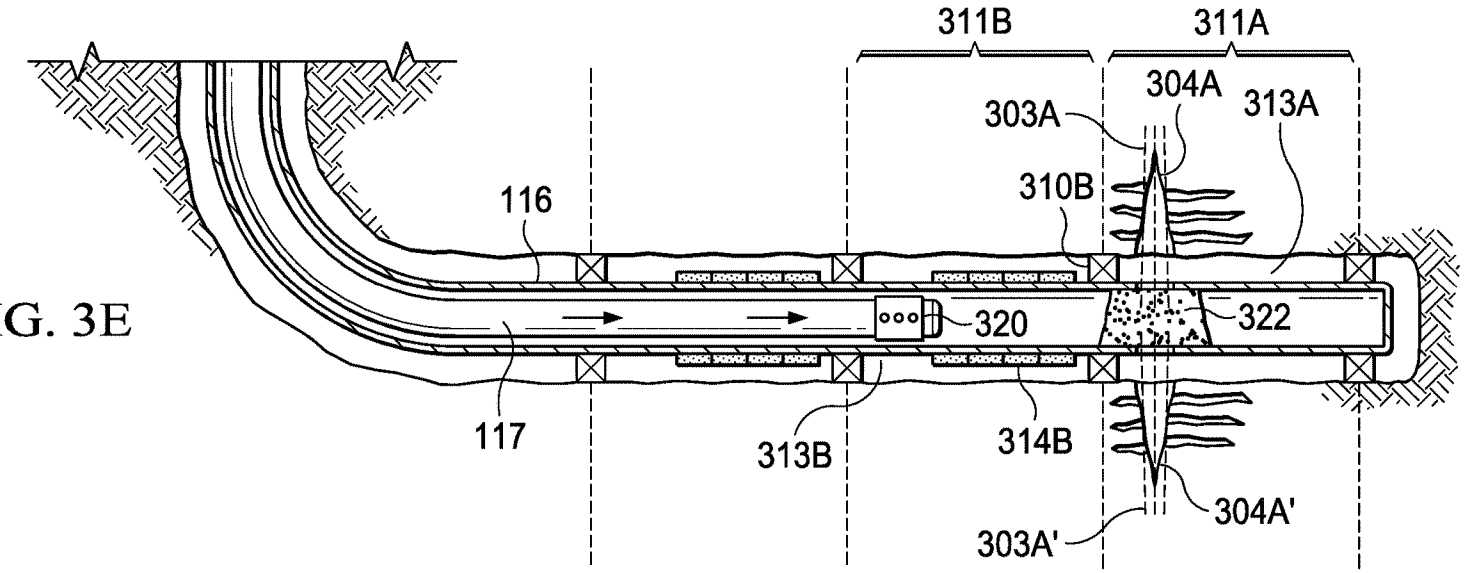
FIG. 3E is a cross-sectional view of the well production enhancement system of FIG. 3D after isolation materials are pumped through the inner conveyance into the outer conveyance to isolate the perforated zone of interest.
Figure 3F:
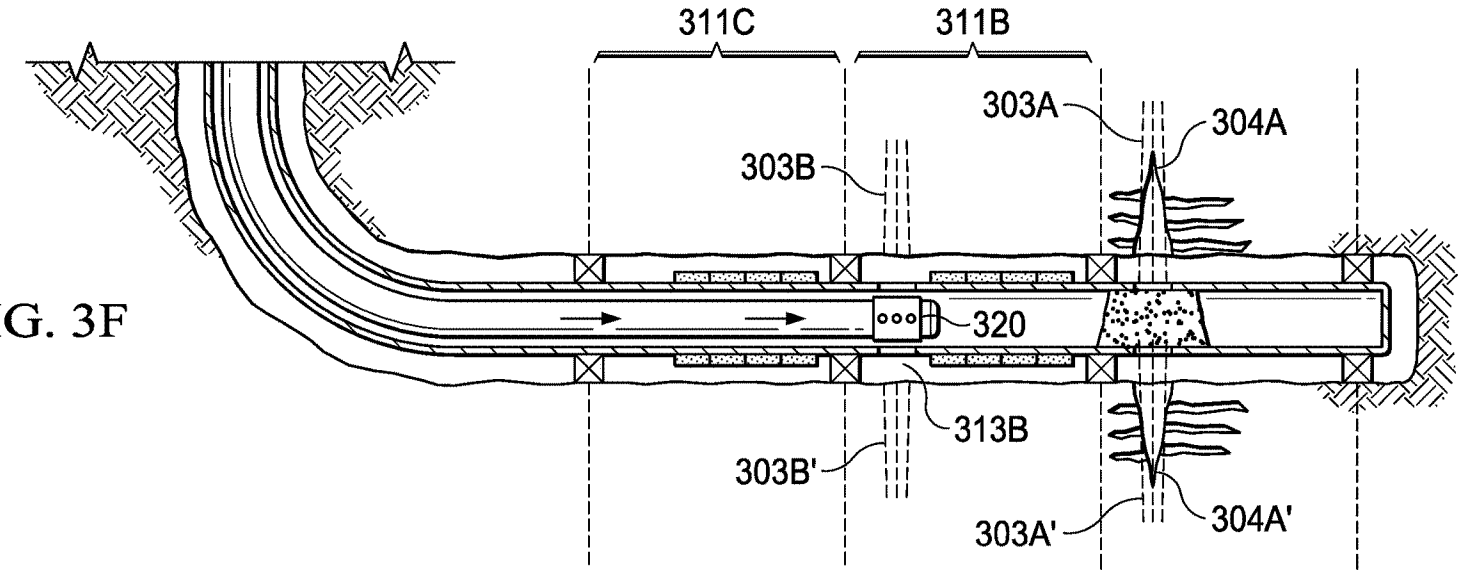
FIG. 3F is a cross-sectional view of the well production enhancement system of FIG. 3E after the perforation tool is actuated to perforate the zone of interest.

Upon completion of the fracture enhancement process to enhance fractures 304A and 304A', isolation materials are then pumped through conveyance 117 to isolate perforations through conveyance 116. In that regard, FIG. 3E is a cross-sectional view of the well production enhancement system of FIG. 3D after isolation materials 322 are pumped through conveyance 117 into conveyance 116 to isolate the perforated zone of interest 313A in isolation zone 311A. Inner conveyance 117 and perforation tool 320 are then re-deployed to isolation zone 311B and zone of interest 313B in isolation zone 311B, respectively. As shown in FIG. 3E, propellants 314B are not deployed in zone of interest 313B to allow perforation tool 320 to actuate within zone of interest 313B without detonating propellants 314B. FIG. 3F is a cross-sectional view of the well production enhancement system of FIG. 3E after perforation tool 320 is actuated to perforate zone of interest 313B in isolation zone 311B. As shown in FIG. 3F, perforations 303B and 303B' are formed in conveyance 116 and formation 126 along zone of interest 313B. Further, the operations described above and illustrated in FIGS. 3A-3E are repeated to enhance well production in each of isolated zones 311B and 311C, as well as other isolated zones (not shown).

Figure 4:
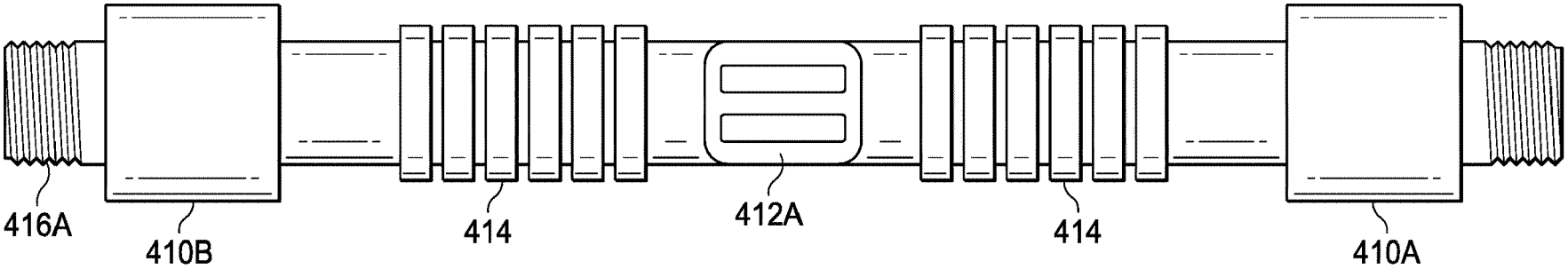
FIG. 4 is a cross-sectional view of a conveyance joint of an outer conveyance of a well production enhancement system similar to the well production enhancement system of FIG. 1 and deployed in a cased wellbore.

FIG. 4 is a cross-sectional view of a conveyance joint 416A of an outer conveyance of a well production enhancement system similar to the well production enhancement system of FIG. 1 and deployed in a cased wellbore. In some embodiments, a perforation operation similar to the perforation operation described and illustrated in FIGS. 3B and 3E is performed throughout multiple or all zones of interest along the cased wellbore. In some embodiments, some propellants are detonated before other propellants to create a pulsing effect, which enhances fractures generated along the formation. Conveyance joints, such as conveyance joint 416A are then deployed after the perforation operation has completed. The conveyance joints are connected to each other to form an outer conveyance, such as conveyance 116 of FIG. 3A. As shown in FIG. 4, conveyance joint 416A is coupled to isolation devices 410A and 410B, which when deployed, form an isolation zone that isolates conveyance joint 416A from other adjacent conveyance joints (not shown). For example, where conveyance joint 416A is deployed in the wellbore 114 of FIG. 3A, isolation devices 410A and 410B actuate to form isolation zone 311A of FIG. 3A. Conveyance joint 416A also includes a sliding sleeve 412A and propellants 414. After connecting the conveyance joints, propellants 414 are detonated to form fractures in the formation proximate to conveyance joint 416A. Further, an inner conveyance (not shown) is deployed or re-deployed in conveyance joint 416A. In some embodiments, the inner conveyance actuates sliding sleeve 412A to provide a fluid flow path for fluids such as fracture enhancement fluids from the outer conveyance, through sliding sleeve 412A, out of conveyance joint 416A, and into the created fractures. Fracture enhancement fluids are then pumped through the outer conveyance, out of the outer conveyance through the sliding sleeve, and into the fractures to enhance the fractures. Sliding sleeve 412A is closed after completion of well production enhancement operations along conveyance joint 416A. In some embodiments, the inner conveyance is re-deployed to another conveyance joint (not shown), and operations to detonate propellants deployed along the other conveyance joint, open a sliding sleeve, pump fracture enhancement fluids into the fractures, and close the sliding sleeve are repeated.

Figure 5:
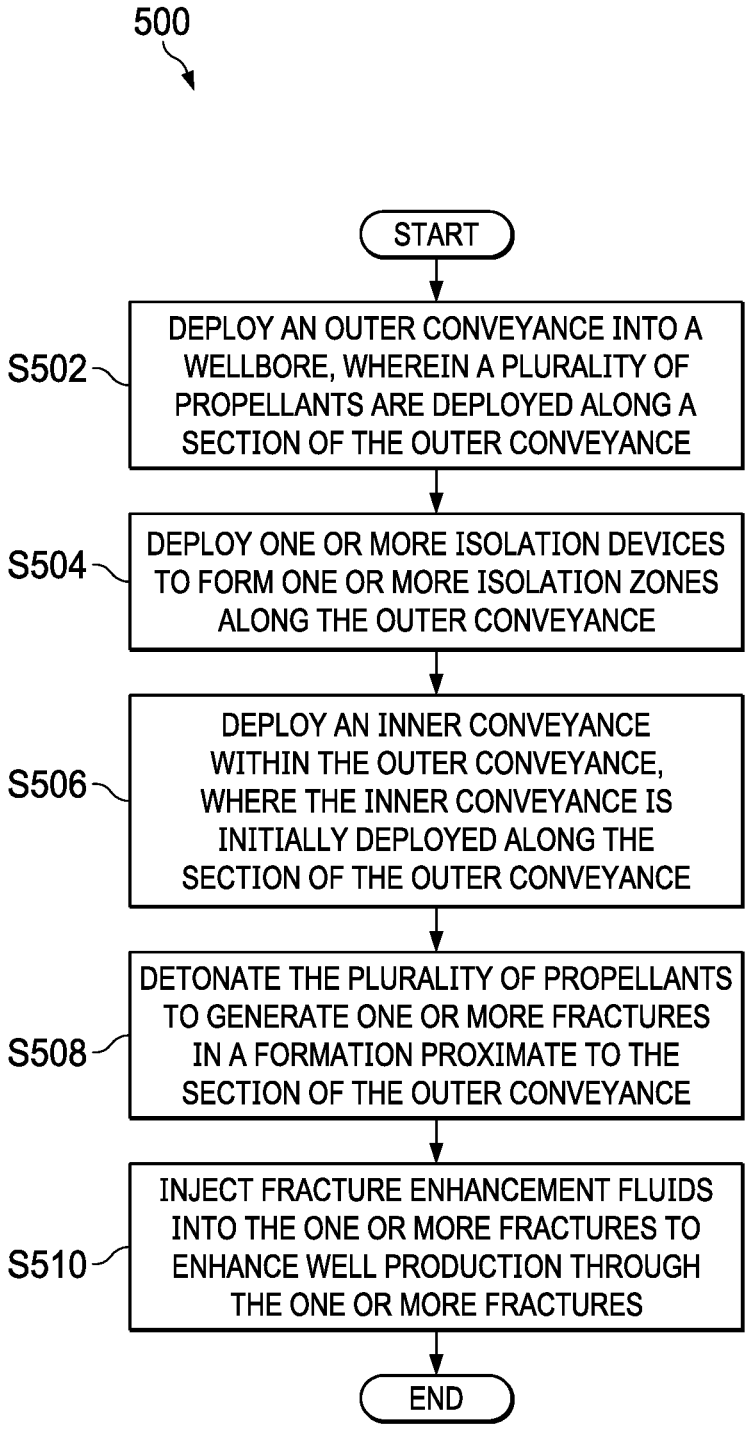
FIG. 5 is a flow chart illustrating a process to enhance well production.

FIG. 5 is a flow chart of a process 500 to enhance well production. Although the operations in process 500 are shown in a particular sequence, certain operations may be performed in different sequences or at the same time where feasible. At block S502, an outer conveyance is deployed into a wellbore. FIG. 2A, for example, illustrates deploying conveyance 116 into wellbore 114. Further, in the embodiment of FIG. 2A, conveyance 116 is a work string. At block S504, one or more isolation devices are deployed to form one or more isolation zones along the outer conveyance. FIG. 2A, for example, illustrates deploying isolation devices 210A-210D to form isolation zones 211A-211C. At block S506, an inner conveyance is deployed inside of the outer conveyance, where the inner conveyance is initially deployed along a section of the outer conveyance. FIG. 2A, for example, illustrates deploying conveyance 117 in conveyance 116. Further, FIG. 2A illustrates initially deploying conveyance 117 in a section of conveyance 116 within isolation zone 211A. In the embodiment of FIG. 2A, conveyance 117 is a coiled tubing.

At block S508, a plurality of propellants deployed along the section is detonated to generate one or more fractures in a formation proximate to the section. FIG. 2B, for example, illustrates detonating propellants 214A of FIG. 2A to generate fractures 204A and 204B in isolation zone 211A. At block S510, fracture enhancement fluids are injected into the one or more fractures to enhance well production through the one or more fractures. FIG. 2C, for example, illustrates injection of fracture enhancement fluids (not shown) into fractures 204A and 204A' to enhance the respective fractures 204A and 204A'.

In some embodiments, the fracture enhancement fluids are pressurized and then injected into the fractures to further enhance the fractures. In one or more of such embodiments, the fracture enhancement fluids are pressurized before the propellants are detonated and are pumped into the outer conveyance after the propellants have detonated to generate fractures along the wellbore. In some embodiments, the outer conveyance has one or more sliding sleeves deployed along different sections of the outer conveyance. In one of more of such embodiments, a sliding sleeve is actuated to provide a fluid flow path out of the outer conveyance. FIG. 2C, for example, illustrates conveyance 117 actuating sliding sleeve 212A, and fracture enhancement fluids flowing out of conveyance 116, through sliding sleeve 212A, and eventually into fractures 204A and 204A'. In some embodiments, after completion of well production enhancement operations in an isolation zone, the inner conveyance is re-deployed to another isolation zone and the foregoing operations illustrated in blocks S508 and S510 are repeated to form fractures in each isolation zone and to enhance well production operations in each respective isolation zone.

In some embodiments, a perforation tool such as a hydrojet or a perforation gun is actuated to perforate a zone of interest of an isolated zone before propellants in the isolated zone are detonated. FIG. 3B, for example, illustrates actuating perforation tool 320 in zone of interest 313A of isolation zone 311A to form perforations 303A and 303A' through conveyance 116 and formation 126 prior to detonating propellants 314A. In one or more of such embodiments, isolation materials are injected into the perforated zone of interest after the fracture enhancement fluids are injected into the fractures. FIGS. 3D and 3E, for example, illustrate injecting fracture enhancement fluids into fractures 304A and 304A', and after enhancing fractures 304A and 304A', injecting isolation materials 322 to isolate perforated zone of isolation 313A. In one or more of such embodiments, the zone of interest is along a blank section of the outer conveyance. In one or more of such embodiments, the zone of interest is an area of that does not contain propellants. In one or more of such embodiments, performing perforating operations in the zone of interest do not detonate the propellants that are deployed along the outer conveyance.

Figure 6:
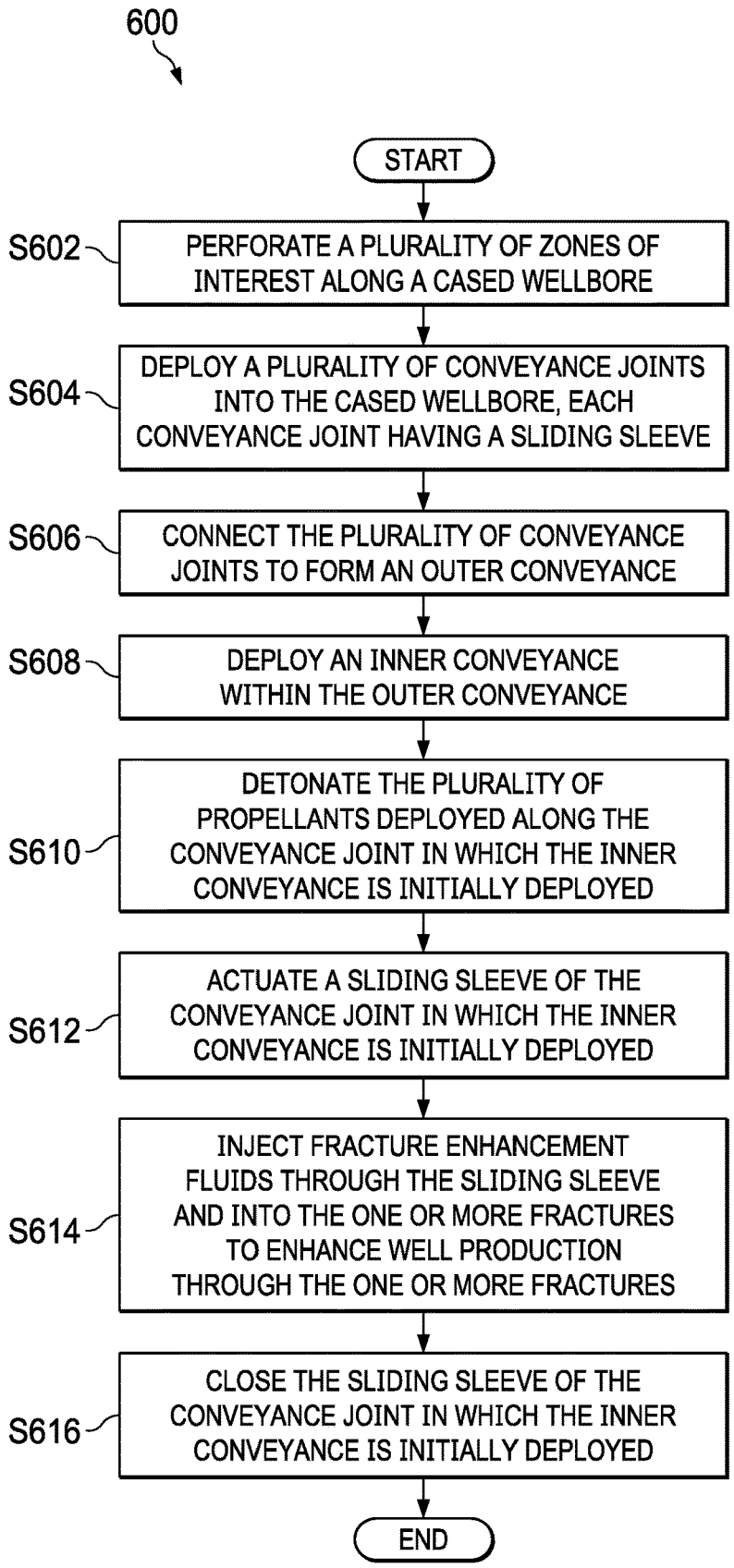
FIG. 6 is a flow chart illustrating another process to enhance well production.

FIG. 6 is a flow chart of a process 600 to enhance well production. Although the operations in process 600 are shown in a particular sequence, certain operations may be performed in different sequences or at the same time where feasible.

At block S602, a plurality of zones of interest along a cased wellbore are perforated. At block S604, a plurality of conveyance joints are deployed into the cased wellbore, where each conveyance joint has a sliding sleeve and one or more isolation devices operable to form an isolation zone along the respective conveyance joint. FIG. 4, for example, illustrates conveyance joint 416A having two isolation devices 410A and 410B, and sliding sleeve 412A. At block S606, the plurality of conveyance joints are connected to form an outer conveyance. Conveyance joint 416A, for example, may be connected to other conveyance joints (not shown) to form conveyance 116 of FIG. 3A.

At block S608, an inner conveyance is deployed inside of the outer conveyance, where the inner conveyance is initially deployed along a conveyance joint of the outer conveyance. An inner conveyance, such as conveyance 117 of FIG. 3A for example, is deployable within conveyance joint 416A of FIG. 4. In some embodiments, all of the isolation devices of the outer conveyance are deployed before the inner conveyance is deployed within the outer conveyance. In some embodiments, only the isolation devices of a conveyance joint in which the inner conveyance is current deployed are deployed to isolate the conveyance joint.

At block S610, a plurality of propellants deployed along the conveyance joint in which the inner conveyance is initially deployed are detonated to generate one or more fractures in a formation proximate to said conveyance joint. In some embodiments, propellants 414 of FIG. 4 are detonated to generate fractures in a formation proximate to conveyance joint 416A. At block S612, a sliding sleeve of the conveyance joint in which the inner conveyance is initially deployed is actuated. Continuing the foregoing example where conveyance 117 of FIG. 3A is deployed in conveyance joint 416A of FIG. 4, in one or more of such embodiments, conveyance 117 is operable to actuate sliding sleeve 412A to provide a flow path through conveyance joint 416A and into the surrounding wellbore. At block S614, fracture enhancement fluids are injected through the sliding sleeve and into the one or more fractures to enhance well production through the one or more fractures. At block S616, the sliding sleeve of the conveyance joint in which the inner conveyance is initially deployed is closed. Continuing the foregoing example where conveyance 117 of FIG. 3A is deployed in conveyance joint 416A of FIG. 4, conveyance 117 is operable to close the sliding sleeve after completion of the well production enhancement operations around conveyance joint 416A. In some embodiments, after completion of well production enhancement operations around a conveyance joint such as conveyance joint 416A of FIG. 4, the inner conveyance is re-deployed to another conveyance joint and the foregoing operations illustrated in blocks S610, S612, S614, and S616 are repeated to form fractures around each conveyance joint and to enhance well production operations in each conveyance joint.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a method to enhance well production, the method comprising deploying an outer conveyance into a wellbore, wherein a plurality of propellants are deployed along a section of the out conveyance; deploying one or more isolation devices to form one or more isolation zones along the outer conveyance; deploying an inner conveyance within the outer conveyance, wherein the inner conveyance is initially deployed along the section of the outer conveyance; detonating the plurality of propellants to generate one or more fractures in a formation proximate to the section of the outer conveyance; and injecting fracture enhancement fluids into the one or more fractures to enhance well production through the one or more fractures.

Clause 2, the method of clause 1, further comprising: pressurizing the fracture enhancement fluids; and after detonating the plurality of propellants, actuating a sliding sleeve deployed in the section of the outer conveyance, wherein injecting the fracture enhancement fluids comprises injecting the pressurized fracture enhancement fluids through the sliding sleeve and into the one or more fractures.

Clause 3, the method of clause 2, wherein the fracture enhancement fluids are pressurized prior to detonating the plurality of propellants.

Clause 4, the method of clauses 2 or 3, wherein the fracture enhancement fluids comprise one or more of fracture fluids and treatment fluids.

Clause 5, method of clause 1, further comprising: actuating a perforation tool to perforate a zone of interest along the section of the outer conveyance, and wherein the perforation tool is actuated prior to detonating the plurality of propellants; and after injecting the fracture enhancement fluids, injecting an isolation material to isolate the perforated zone of interest along the section of the outer conveyance.

Clause 6, the method of clause 5, further comprising: pressurizing the fracture enhancement fluids prior to detonating the plurality of propellants, wherein injecting the fracture enhancement fluids comprises after perforating a zone of interest along the section of the outer conveyance, injecting the pressurized fracture enhancement fluids through the perforated zone of interest along the section of the outer conveyance.

Clause 7, the method of clause 6, wherein the fracture enhancement fluids comprise one or more of fracture fluids and treatment fluids.

Clause 8, the method of clauses 6 or 7, wherein the zone of interest is along a blank section of the outer conveyance.

Clause 9, the method of any of clauses 1-8, wherein injecting fracture enhancement fluids comprises injecting fracture enhancement fluids into the one or more fractures while the plurality of propellants are being detonated, and wherein the plurality of propellants are detonated in a time sequence to provide pulsing effect on the generated pressure.

Clause 10, the method of any of clauses 1-9, wherein the outer conveyance is a working string, wherein the inner conveyance is a coiled tubing, and wherein the plurality of propellants are ignited after deployment of the coiled tubing within the work string.

Clause 11, a method to enhance well production, the method comprising: perforating a plurality of zones of interest along a cased wellbore; deploying a plurality of conveyance joints into the cased wellbore, each conveyance joint having a sliding sleeve and one or more isolation devices operable to form an isolation zone along the respective conveyance joint, and each conveyance joint having a plurality of propellants deployed along the respective conveyance joint; connecting the plurality of conveyance joints to form an outer conveyance; deploying an inner conveyance within the outer conveyance, wherein the inner conveyance is initially deployed along a conveyance joint of the outer conveyance; detonating the plurality of propellants deployed along the conveyance joint in which the inner conveyance is initially deployed to generate one or more fractures in a formation proximate to said conveyance joint; actuating a sliding sleeve of the conveyance joint in which the inner conveyance is initially deployed; injecting fracture enhancement fluids through the sliding sleeve and into the one or more fractures to enhance well production through the one or more fractures; and closing the sliding sleeve of the conveyance joint in which the inner conveyance is initially deployed.

Clause 12, the method of clause 11, further comprising deploying the one or more isolation devices of each conveyance joint of the plurality of conveyance joints prior to deploying the inner conveyance within the outer conveyance.

Clause 13, the method of clause 11, further comprising deploying the one or more isolation devices of the conveyance joint in which the inner conveyance is initially deployed.

Clause 14, the method of clauses 11-13, further comprising re-deploying an inner conveyance to an adjacent conveyance joint and within the outer conveyance; detonating the plurality of propellants deployed along the adjacent conveyance joint to generate one or more fractures in the formation proximate to the adjacent conveyance joint; actuating a sliding sleeve of the adjacent conveyance joint; injecting fracture enhancement fluids through the sliding sleeve of the adjacent conveyance joint and into the one or more fractures in the formation proximate to the adjacent conveyance joint to enhance well production through said one or more fractures; and closing the sliding sleeve of the adjacent conveyance joint.

Clause 15, a well production enhancement system, comprising an outer conveyance deployed in a wellbore and having a plurality of sections; a plurality of isolation devices deployed along the outer conveyance, wherein deployment of the plurality of isolation devices forms a plurality of isolation zones along the outer conveyance; a plurality of propellants deployed along each section of the outer conveyance, wherein detonation of one or more of the plurality of the propellants generate one or more fractures proximate a section of the outer conveyance where the one or more of the plurality of propellants are deployed; and an inner conveyance deployable within the outer conveyance, the inner conveyance providing a fluid flow path for fracture enhancement fluids to flow within the inner conveyance, and into the one or more fractures to enhance well production through the one or more fractures.

Clause 16, the well production enhancement system of clause 15, further comprising one or more sliding sleeves deployed along the plurality of sections of the outer conveyance, wherein the inner conveyance is operable to actuate the one or more sliding sleeves, and wherein the fracture enhancement fluids flow through the one or more sliding sleeves into the one or more fractures.

Clause 17, the well production enhancement system of clauses 15 or 16, further comprising a tool operable to perforate a plurality of zones of interest along the outer conveyance.

Clause 18, the well production enhancement system of clause 17, wherein the plurality of zones of interest are perforated before the inner conveyance is deployed within the outer conveyance.

Clause 19, the well production enhancement system of clause 17, wherein the plurality of zones of interest are perforated before the outer conveyance is deployed in the wellbore.

Clause 20, the well production enhancement system of clauses 17-19, wherein the tool is at least one of a perforating gun and a hydrojet/hydrajet tool.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A method to enhance well production, the method comprising:

deploying an outer conveyance into a wellbore, wherein a plurality of propellants are deployed along a section of the outer conveyance;

deploying one or more isolation devices to form one or more isolation zones along the outer conveyance;

deploying an inner conveyance within the outer conveyance, wherein the inner conveyance is initially deployed along the section of the outer conveyance;

detonating the plurality of propellants to generate one or more fractures in a formation proximate to the section of the outer conveyance in a time sequence to create a pulsing effect; and injecting fracture enhancement fluids into the one or more fractures to enhance well production through the one or more fractures after one or more of the plurality of propellants are detonated.

2. The method of claim 1, further comprising:

pressurizing the fracture enhancement fluids; and after detonating the plurality of propellants, actuating a sliding sleeve deployed in the section of the outer conveyance, wherein injecting the fracture enhancement fluids comprises injecting the pressurized fracture enhancement fluids through the sliding sleeve and into the one or more fractures.

3. The method of claim 2, wherein the fracture enhancement fluids are pressurized prior to detonating the plurality of propellants.

4. The method of claim 2, wherein the fracture enhancement fluids comprise one or more of fracture fluids and treatment fluids.

5. The method of claim 1, further comprising:

actuating a perforation tool to perforate a zone of interest along the section of the outer conveyance, and wherein the perforation tool is actuated prior to detonating the plurality of propellants; and after injecting the fracture enhancement fluids, injecting an isolation material to isolate the perforated zone of interest along the section of the outer conveyance.

6. The method of claim 5, further comprising:

pressurizing the fracture enhancement fluids prior to detonating the plurality of propellants, wherein injecting the fracture enhancement fluids comprises after perforating a zone of interest along the section of the outer conveyance, injecting the pressurized fracture enhancement fluids through the perforated zone of interest along the section of the outer conveyance.

7. The method of claim 6, wherein the fracture enhancement fluids comprise one or more of fracture fluids and treatment fluids.

8. The method of claim 5, wherein the zone of interest is along a blank section of the outer conveyance.

9. The method of claim 1, wherein the outer conveyance is a working string, wherein the inner conveyance is a coiled tubing, and wherein the plurality of propellants are ignited after deployment of the coiled tubing within the work string.

10. A method to enhance well production, the method comprising:

perforating a plurality of zones of interest along a cased wellbore;

deploying a plurality of conveyance joints into the cased wellbore, each conveyance joint having a sliding sleeve and one or more isolation devices operable to form an isolation zone along the respective conveyance joint, and each conveyance joint having a plurality of propellants deployed along the respective conveyance joint;

connecting the plurality of conveyance joints to form an outer conveyance;

deploying an inner conveyance within the outer conveyance, wherein the inner conveyance is initially deployed along a conveyance joint of the outer conveyance;

detonating the plurality of propellants deployed along the conveyance joint in which the inner conveyance is initially deployed to generate one or more fractures in a formation proximate to said conveyance joint;

actuating a sliding sleeve of the conveyance joint in which the inner conveyance is initially deployed;

injecting fracture enhancement fluids through the sliding sleeve and into the one or more fractures to enhance well production through the one or more fractures; and closing the sliding sleeve of the conveyance joint in which the inner conveyance is initially deployed.

11. The method of claim 10, further comprising deploying the one or more isolation devices of each conveyance joint of the plurality of conveyance joints prior to deploying the inner conveyance within the outer conveyance.

12. The method of claim 10, further comprising deploying the one or more isolation devices of the conveyance joint in which the inner conveyance is initially deployed.

13. The method of claim 10, further comprising re-deploying an inner conveyance to an adjacent conveyance joint and within the outer conveyance;

detonating the plurality of propellants deployed along the adjacent conveyance joint to generate one or more fractures in the formation proximate to the adjacent conveyance joint;

actuating a sliding sleeve of the adjacent conveyance joint;

injecting fracture enhancement fluids through the sliding sleeve of the adjacent conveyance joint and into the one or more fractures in the formation proximate to the adjacent conveyance joint to enhance well production through said one or more fractures; and closing the sliding sleeve of the adjacent conveyance joint.

14. A well production enhancement system, comprising:

an outer conveyance deployed in a wellbore and having a plurality of sections;

a plurality of isolation devices deployed along the outer conveyance, wherein deployment of the plurality of isolation devices forms a plurality of isolation zones along the outer conveyance;

a plurality of propellants deployed along each section of the outer conveyance and configured to be detonated in a time sequence to create a pulsing effect, wherein detonation of one or more of the plurality of the propellants generate one or more fractures proximate a section of the outer conveyance where the one or more of the plurality of propellants are deployed; and an inner conveyance deployable within the outer conveyance, the inner conveyance providing a fluid flow path for fracture enhancement fluids to flow within the inner conveyance, and into the one or more fractures to enhance well production through the one or more fractures after at least one of the one or more propellants is detonated.

15. The well production enhancement system of claim 14, further comprising one or more sliding sleeves deployed along the plurality of sections of the outer conveyance, wherein the inner conveyance is operable to actuate the one or more sliding sleeves, and wherein the fracture enhancement fluids flow through the one or more sliding sleeves into the one or more fractures.

16. The well production enhancement system of claim 14, further comprising a tool operable to perforate a plurality of zones of interest along the outer conveyance.

17. The well production enhancement system of claim 16, wherein the plurality of zones of interest are perforated before the inner conveyance is deployed within the outer conveyance.

18. The well production enhancement system of claim 16, wherein the plurality of zones of interest are perforated before the outer conveyance is deployed in the wellbore.

19. The well production enhancement system of claim 16, wherein the tool is at least one of a perforating gun and a hydrojet tool.

* * * * *